United States Patent [19]

Carter

[11] 4,422,360

[45] Dec. 27, 1983

[54] DEVICE FOR IMPROVING PIANO TONE QUALITY

[76] Inventor: Barry E. Carter, 1721 10th Ave., San Francisco, Calif. 94122

[21] Appl. No.: 296,000

[22] Filed: Aug. 25, 1981

Related U.S. Application Data

[63] Continuation-in-part of Ser. No. 82,740, Oct. 9, 1979, abandoned.

[51] Int. Cl.[3] ..... G10H 3/00

[52] U.S. Cl. ..... 84/1.11; 84/1.19

[58] Field of Search ..... 84/1.01, 1.04, 1.24, 84/1.26, 1.11, 1.19; 179/1 A, 1 D

[56] References Cited

U.S. PATENT DOCUMENTS

| | | | |
|---|---|---|---|
| 2,952,179 | 9/1960 | Andersen | 84/1.24 |
| 3,189,788 | 6/1965 | Cady | 315/129 |
| 3,240,949 | 3/1966 | Balkow et al. | 307/66 |
| 3,538,805 | 11/1970 | Uetrecht | 84/1.11 |
| 3,626,077 | 12/1971 | Munch, Jr. et al. | 84/1.01 |
| 3,644,656 | 2/1972 | Fender et al. | 84/1.04 |
| 3,700,811 | 10/1972 | Davidson | 179/1 D |
| 3,935,783 | 2/1976 | Machanian | 84/1.21 |
| 3,949,325 | 4/1976 | Berkovitz | 333/28 R |
| 4,038,559 | 7/1977 | Chun et al. | 307/64 |
| 4,202,237 | 5/1980 | Hakansson | 84/1.24 |
| 4,211,138 | 7/1980 | Deutsch | 84/1.01 |
| 4,211,893 | 7/1980 | Smith | 179/1 A |
| 4,214,502 | 7/1980 | Holpuch et al. | 84/1.24 |
| 4,218,950 | 8/1980 | Vetrecht | 84/1.19 |
| 4,236,434 | 12/1980 | Nishibe | 84/1.19 |
| 4,274,321 | 6/1981 | Swartz | 84/1.26 |

*Primary Examiner*—F. W. Isen

*Attorney, Agent, or Firm*—David B. Harrison

[57] ABSTRACT

An amplifier circuit for automatically altering in a controlled way the reproduced tones of an electronic piano comprises a main signal path for the fundamental tones and an overtone path including a plurality of tone altering electronic networks and field effect transistor amplifiers combining the networks. The circuits includes separate controls for manual adjustment of normal level gain, bass boost, overtone, output volume and gate control threshold. A mixer recombines the main path and the overtone path. A gate circuit may be provided to disable the overtone path when no signal is present in the main path over a predetermined minimum threshold. The entire device is constructed for mounting over the keyboard of the piano, with a panel for the controls which renders them readily accessible for regulation by the musician to obtain the desired improvement and alteration of the tones put out by the piano.

9 Claims, 5 Drawing Figures

41 PIANO KEYBOARD
42 FIRST SUPPORT & POWER SUPPLY BOX
43 SECOND SUPPORT
44 POWER SUPPLY TRANSFORMER & RECTIFIER
45 POWER CONTROL SWITCH
46 CONTROL PANEL
47 AMPLIFIER CIRCUIT HOUSING
48 CONNECTOR FROM PIANO HARP
49 TO CHARGEABLE BATTERIES
50 OUTPUT CONNECTOR TO LOUDSPEAKER
51 VOLUME POTENTIOMETER
52 NORMAL CONTROL POTENTIOMETER
53 OVERTONE CONTROL POTENTIOMETER
54 BASS BOOST POTENTIOMETER
55 LIGHT EMITTING DIODE ON CHARGING LINE

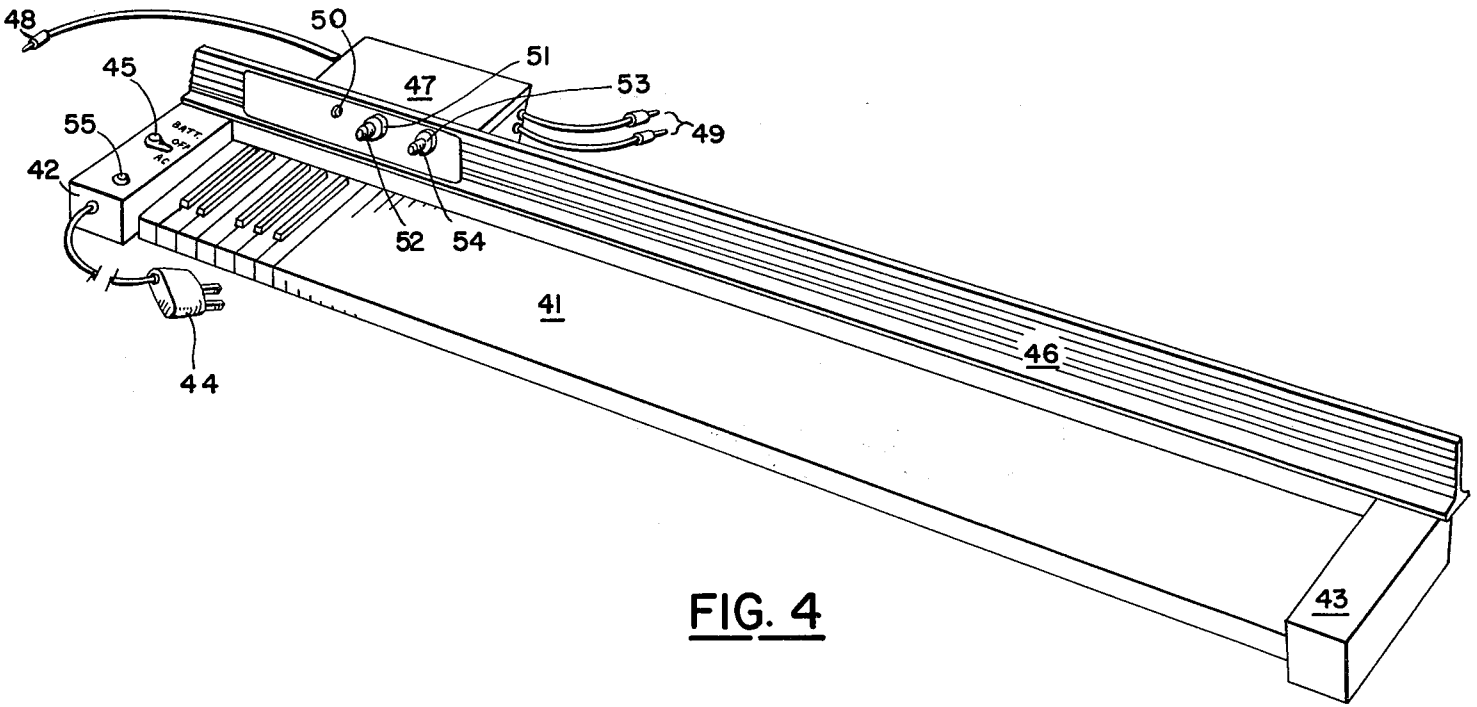

FIG. 4

DEVICE FOR IMPROVING PIANO TONE QUALITY

BACKGROUND OF THE INVENTION

This application is a continuation-in-part of U.S. patent application, Ser. No. 06/082,740, filed on Oct. 9, 1979, now abandoned.

Electronic pianos utilizing tone generators such as vibrating reeds comprising an element of a resonating tuning fork in combination with a pick-up element for an electromechanical transducer are well known in the prior art. Those pick-up elements include a transducer which converts the vibration of the reeds of the tuning fok structure into electrical signals capable of being amplified greatly and then reconverted to sound vibrations by a loudspeaker. These tone producing elements are commonly referred to as the "harp" of the piano. This piano has many advantages by way of size, portability and compactness over conventional pianos, but it has some disadvantages in the quality of tones it produces.

Many attempts have been made to improve the tonal quality of the electronic piano, so that its tone quality would be equal to or better than a conventional piano. These efforts have included improvements in the tuning fork and in the piano operation mechanisms. They are cited in detail in the Fender and Rhodes U.S. Pat. No. 3,644,656. The present invention solves the problem by improving the amplifier circuit itself. The improved amplifier is placed between the tuning fork and the loudspeaker amplifier thereby to improve the final tonal quality. In addition an automatic gating circuit may be included in the circuit to provide an override of some of the functions of the inventive circuit automatically, whenever such functions are not required or appropriate as determined by the musician's play of the piano.

One of the principal problems in connection with electronic pianos is the production of objectional overtones or harmonics. Another disadvantage is the inability to control the bass and treble response of the piano independently. The prior efforts to solve these problems known to the applicant are shown in the following patents:

The Anderson U.S. Pat. No. 2,952,179 utilizes an amplifier comprising a combination of a special power supply connected through a transformer to a full wave rectifier and a plurality of vacuum tubes through a filter to a bus supplying power output and amplifier tubes. Output of the vibrating piano reeds is fed to amplifier tubes through a capacitor and resistor network and potentiometer to an output transformer and to a loudspeaker. Combinations of capacitors and resistors are suitably interposed throughout the circuit as required. A reasonably flat frequency response curve was obtained throughout the audio frequency range. No separate control or amplification of the bass, treble, or overtones was provided.

The Machanian U.S. Pat. No. 3,935,783 employed a square wave generator circuit in combination with the piano key output to control the harmonics producing a quality of piano tone output which limits rather than accentuates the harmonics or overtones.

The Staley U.S. Pat. No. 3,937,115 employed a circuit including a multifrequency generator feeding through a divider bank to diode adders having impedance elements which permitted adding together the amplitude of the predetermined frequency to duplicate the tone quality of a conventional piano through suitable filters and total volume amplifier circuits to a loudspeaker.

The Berkovitz U.S. Pat. No. 3,949,325 described an equalization amplifier including delay circuits in an effort to provide audio equalization for large public rooms such as auditoria. The Berkovitz scheme is not particularly adapted to the peculiar tonal qualities of the electronic piano.

The Davidson U.S. Pat. No. 3,700,811 described an equalizer circuit wherein bass tones were enhanced by increasing total system volume while treble tones were shunted to ground by a variable impedance network including a field effect transitor switch.

The Uetrecht U.S. Pat. No. 3,538,805 described a ladder network employing resistors and capacitors in series connection to achieve a filtering out of higher frequency overtones.

A guitar amplifier was disclosed in the Smith U.S. Pat. No. 4,211,893 which afforded selectable enhancement for solo playing in addition to customary simple amplification.

A variety of power supply circuits were shown in the Balkow et al. U.S. Pat. No. 3,240,949, the Chun et al. U.S. Pat. No. 4,038,559, and the Cady U.S. Pat. No. 3,189,788. While the present invention includes a self contained power supply as an element thereof, its principal aspects are found in the tone modifying circuitry.

Most of the previous efforts were to eliminate the overtones and harmonics produced by the electic piano as being undesirable. On the contrary, the present inventor has discovered that when properly processed and used, these overtones actually enhance and improve the tone quality of the piano as is further explained hereinafter.

SUMMARY

An amplifier circuit incorporating the principles of the present invention includes a plurality of sub-circuits or networks including separate manual controls for aspects of the tones altering function. The inductively reactive output of transducers at the harp of the electronic piano is resonated by a first resonator network in parallel therewith to enhance tonal qualities. The Q of the harp transducers is controlled by selection of parallel resistance in the resonant circuit. A first amplifier increases the audio signal from the resonant circuit and its output is divided into two paths, a main signal path and an overtone path. The main signal path for fundamental tones put out by the piano is amplified by a second amplifier, the gain control of which also simultaneously controls the gain of the first amplifier. A first tone filter, an overtone amplifier and a second tone filter form a circuit path for the overtone path. A mixer combines the main signal path and the overtone path in proper phase relationship, and an output protection circuit limits the audio put out to a predetermined maximum amplitude. The invention may further include a gate circuit connected to switch off the overtone path whenever there are no tones present in the main signal path above a predetermined threshold. A suitable low voltage power supply provides operating potentials to the active circuit elements.

From the foregoing it is apparent that a general object of this invention is to provide a circuit which selectively operates upon the tonal qualities of an electronic piano to improve the tones put out therefrom. Other objects, advantages and features will be apparent to those skilled in the art from a consideration of the following detailed description of a preferred embodiment, presented in conjunction with the accompanying drawing.

BRIEF DESCRIPTION OF THE DRAWINGS

FIG. 2 comprises parts 2A, 2B, 2C, 2D, 2E, and 2F, each of which is a separated network of the circuit.

FIG. 4 is a somewhat diagrammatic view in perspective of the keyboard of an electronic piano, showing the present invention housed and installed for convenient use by the musician.

DETAILED DESCRIPTION OF A PREFERRED EMBODIMENT

Figure 1:
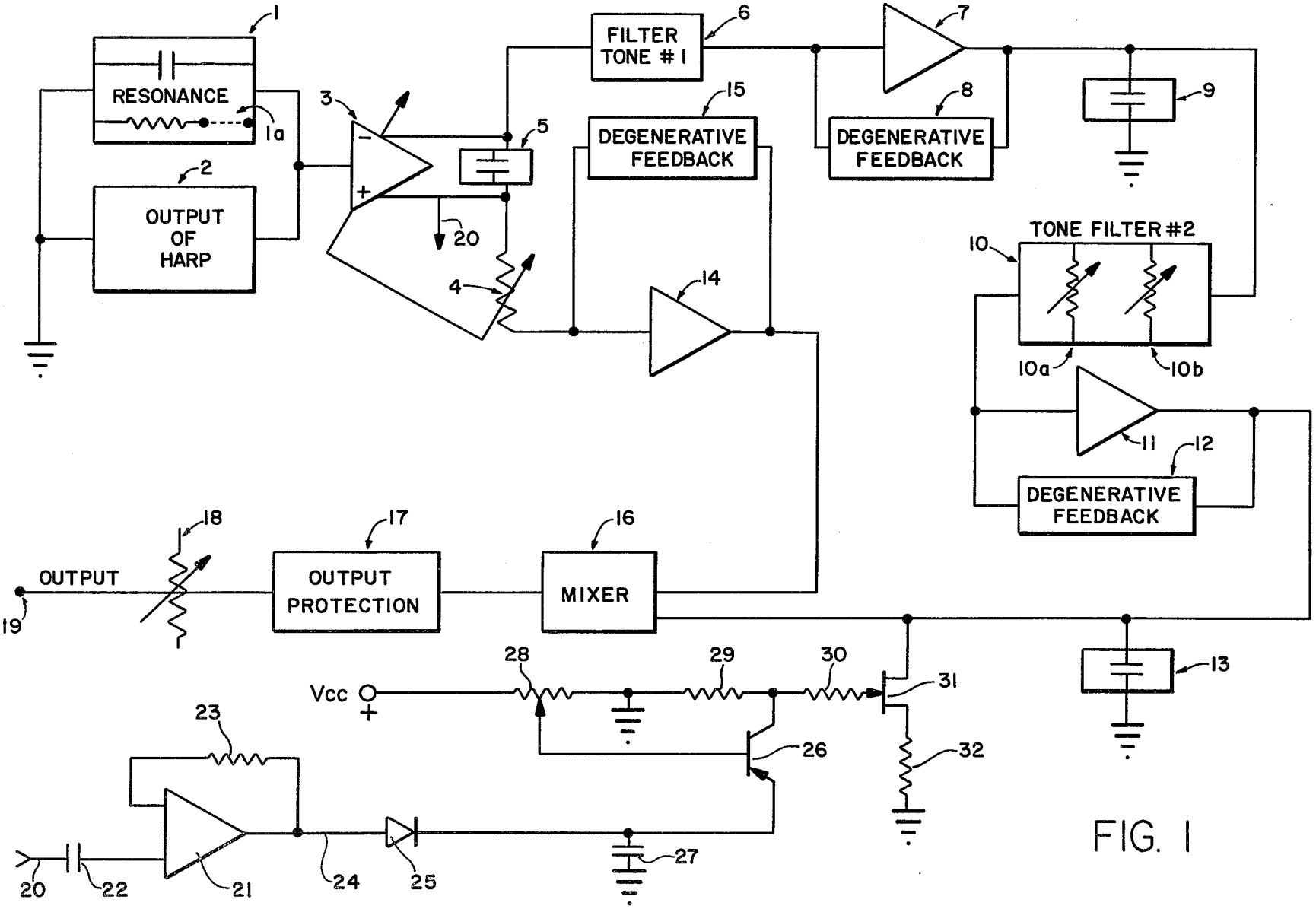
FIG. 1 is a block an partial schematic diagram depicting the principal elements of the circuit of the present invention.

Referring now to FIG. 1, a resonating circuit 1 includes a capacitor and a resistor 1*a* which are connected in parallel across the output 2 of the transducers of the harp of an electronic piano such as the one depicted in FIG. 4. The capacitance value is selected to form a resonant circuit with the inductively reactive transducers at a selected audio passband, preferably in the overtone range. The resistor 1*a* is selected to control the Q, or quality of the resonant circuit formed, thereby enabling a spreading of the bandpass of the resonant circuit, to achieve in part the tonal characteristics depicted in FIG. 3. An amplifier 3 has its input connected to the resonant circuit and its output forming two separate signal paths: an overtone path characterized by a first tone filter 6, an amplifier 7 having degenerative feedback 8 to enhance linearity in the desired audio passband, ultrasonic roll off capacitors 5, 9 and 13, a second tone filter 10 which includes an overtone level control potentiometer 10*a* and a bass boost control 10*b*. Another amplifier 11 which includes degenerative feedback 12 completes the overtone path.

The main signal path includes a gain potentiometer 4 connected to the amplifier 3. The potentiometer 4 is connected to control simultaneously the negative (degenerative) feedback and resultant gain of the amplifier 3 and the main signal path amplitude as provided to an amplifier 14 having degenerative feedback 15.

Outputs from the main signal path amplifier 14 and the overtone signal path output amplifier 11 are recombined in proper phase relationship in a mixer stage 16. An output level protection network 17 and an output volume control potentiometer 18 complete the basic circuit and deliver tone enhanced audio to an output jack 19.

A gate control circuit provides an additional aspect of the present invention and is the new matter added by the inventor in the continuation in part application which led to this patent. The gate circuit is depicted schematically in FIG. 1. A connection 20 is made to the main signal path output from the amplifier 3. This connection provides an input to an operational amplifier 21 through a suitable blocking capacitor 22. The op amp may be type 741 or equivalent. A feedback resistor 23 is selected to bias the amplifier 21 into class A operation. An output 24 passes through a one-way diode 25 which protects against excessive reverse bias upon a subsequent transistor 26. After passing the diode 25, the signal reaches a 5 microfarad bypass capacitor 27 and ends up at the emitter of a PNP switching transistor 26. The transistor is an audio amplifier type with a typical Beta of about 100. A 2N4126 works well. The base of the transistor 26 is connected to a wiper of a 20K ohm potentiometer 28 connected between ground and a positive voltage supply. The pot 28 sets a threshold at which the switching circuit operates. A collector load resistor 29, of about 47K ohm, is connected to ground. A switching control signal is provided at the collector of the transistor 26 and it passes through a resistor 30 to reach the gate of a P channel junction FET 31 which is connected to shunt the overtone channel to ground during conductivity. The resistor 30 and a source to ground resistor 32 establish the amount of shunting effect achieved by the FET switch 31. With the resistors 30 and 32 the switch 31 has a very fast switch-on characteristic and a soft switch-off characteristic. The resistor 32 may be selected to limit the shunting action to an amount less than complete grounding of the overtone channel, should that be desired.

Instead of the shunt connected switching FET 31 as shown in FIG. 1, an equally satisfactory switch may be provided by placing a FET switch in series with the output line of the overtone channel between the capacitor 13 and the input to the mixer 16. Either way, the purpose of the gate circuit is to reduce by a controlled amount the gain of the overtone channel whenever there is no signal present in the main signal path above a controlled threshold level.

Figure 2:
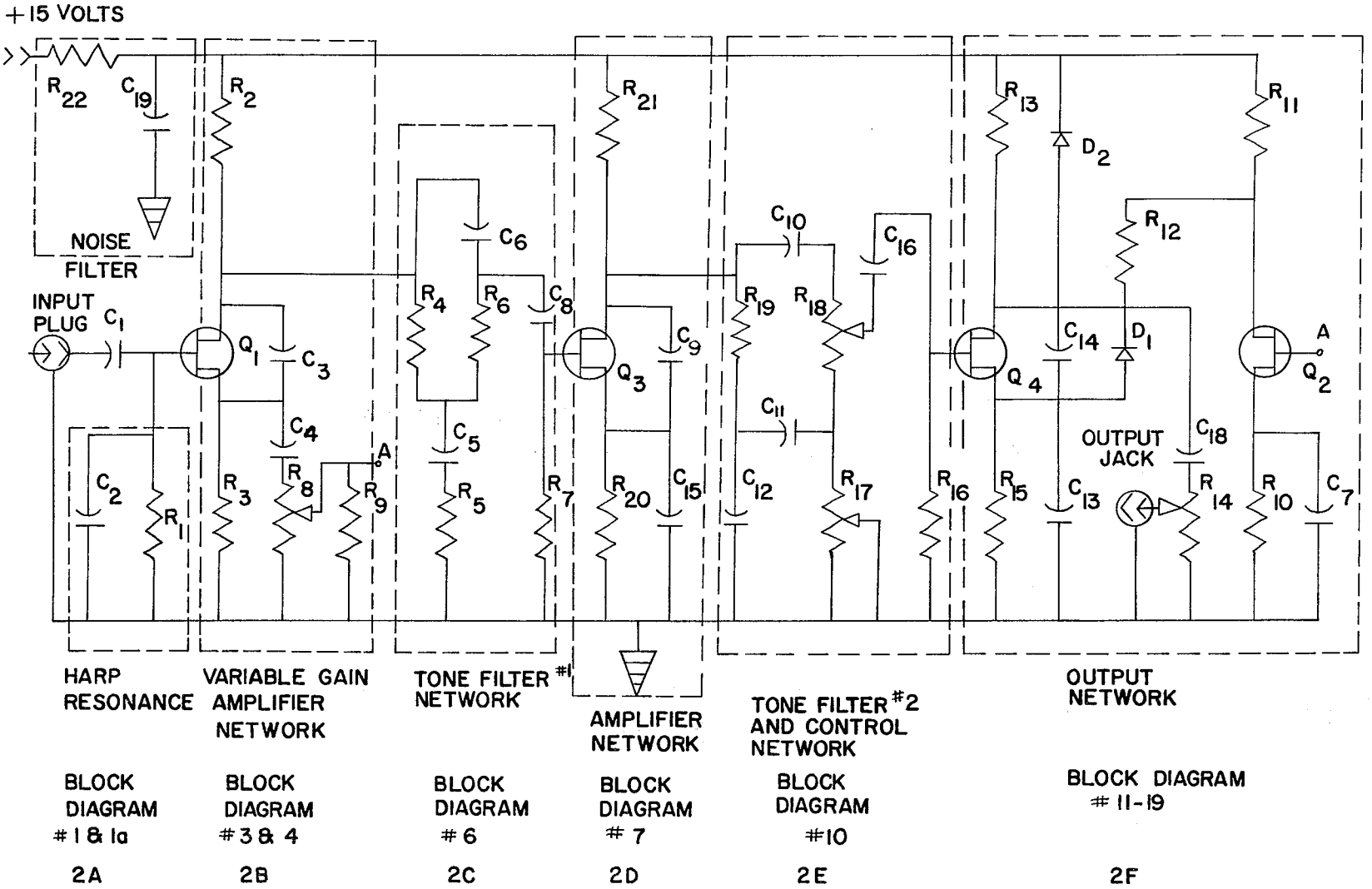
FIG. 2 is schematic diagram presenting more circuit details for the circuit depicted in FIG. 1.

Referring now to FIG. 2 there is seen first the inlet plug from the outlet of the piano harp which connects with a coupling capacitor $C_1$. Next is the harp resonance network as shown at $2_A$ which appears in the block diagram as 1 and 1A and is shown herein as a resistor $R_1$ and capacitor $C_2$ in parallel connection with the input.

The next component of the circuit is the variable gain amplifier network $2_B$ which appears on the bolck diagram as item 3 and 4. This comprises first the field effect transistor $Q_1$ connected to the power supply through its bias resistor $R_2$ and having connected across it ultrasonic roll-off capacitor $C_3$. $R_3$ and $C_4$ represent a series parallel resistor-capacitor combination, while $R_8$ represents the potentiometer seen as 4 on the block diagram and which is referred to as the "normal" control. Resistor $R_9$ forms a part of this network and connection A indicates a connection to corresonding A which joins $Q_2$, a transistor forming a part of the output network at the opposite end of the diagram.

The next network shown at $2_C$ is represented as tone filter No. 1 network and appears on the block diagram as No. 6. This comprises a plurality of resistors and capacitors in series parallel connection. They are $R_4$, $R_5$, $R_6$, $C_5$, $C_6$, $C_8$, and $R_7$ connecting to the power input at one end of the network and the common ground as shown on the opposite end.

Next at $2_D$ is seen the amplifier network which appears on block diagram as No. 7. This comprises field effect transistor $Q_3$ connecting with the tone filter No. 1 network. The power supply is connected to $Q_3$ and the latter has connected across it the ultrasonic roll-off capacitor $C_9$ which is 9 on this block diagram and connects with resistor 20 and capacitor $C_{15}$ in parallel forming a part of the degenerative feedback or subsonic roll-off shown at 8 on the block diagram.

Connected next in order to the amplifier network is the tone filter No. 2 and control network which appears on the block diagram as item No. 10. The principal elements are the potentiometers of $R_{17}$ and $R_{18}$ representing the bass and overtone control, respectively together with capacitors $C_{10}$, $C_{11}$, $C_{12}$, $C_{16}$ and resistor $R_{19}$ and $R_{16}$.

This network is joined initially to the output network of transistor $Q_4$ supplied by the common power input and joined in the common ground as shown. This network includes also transistor $Q_2$ which connects back to the variable gain amplifier network at A as described above. Transistor $Q_4$ is connected through it own degenerative feedback "subsonic" elements capacitor $C_{13}$ and resistor $R_{15}$ while transistor $Q_2$ connects through a similar feedback $C_7$ and $R_{10}$. In addition, transistor $Q_4$ has connected across it, its own ultrasonic roll-off capacitor $C_{14}$. Included in the output network are over and under voltage protective diodes $D_1$ and $D_2$ and output mixer resistor $R_{12}$. Also shown are output volume control potentiometer $R_{14}$ connected through capacitor $C_{18}$ which feeds to an output jack adapted for connection to a usual amplification means and a loudspeaker which has its own individual amplifier for transmission of the final sound output loudspeaker not shown.

The inlet for the 15 volt power supply source is provided with a filter combination of resistor-capacitor, namely, $R_{22}$ and $C_{19}$ as shown.

Other combinations of elements may be used to achieve my improved results, but basically the networks shown should be employed connected essentially as shown and containing basically the elements set forth above. The latter may be varied, in magnitude and in some cases even eliminated, but the essential networks should be present. In particular, the variable gain amplifer network connected back to the output network is of paramount importance in obtaining the high tone quality which I do.

Figure 3:
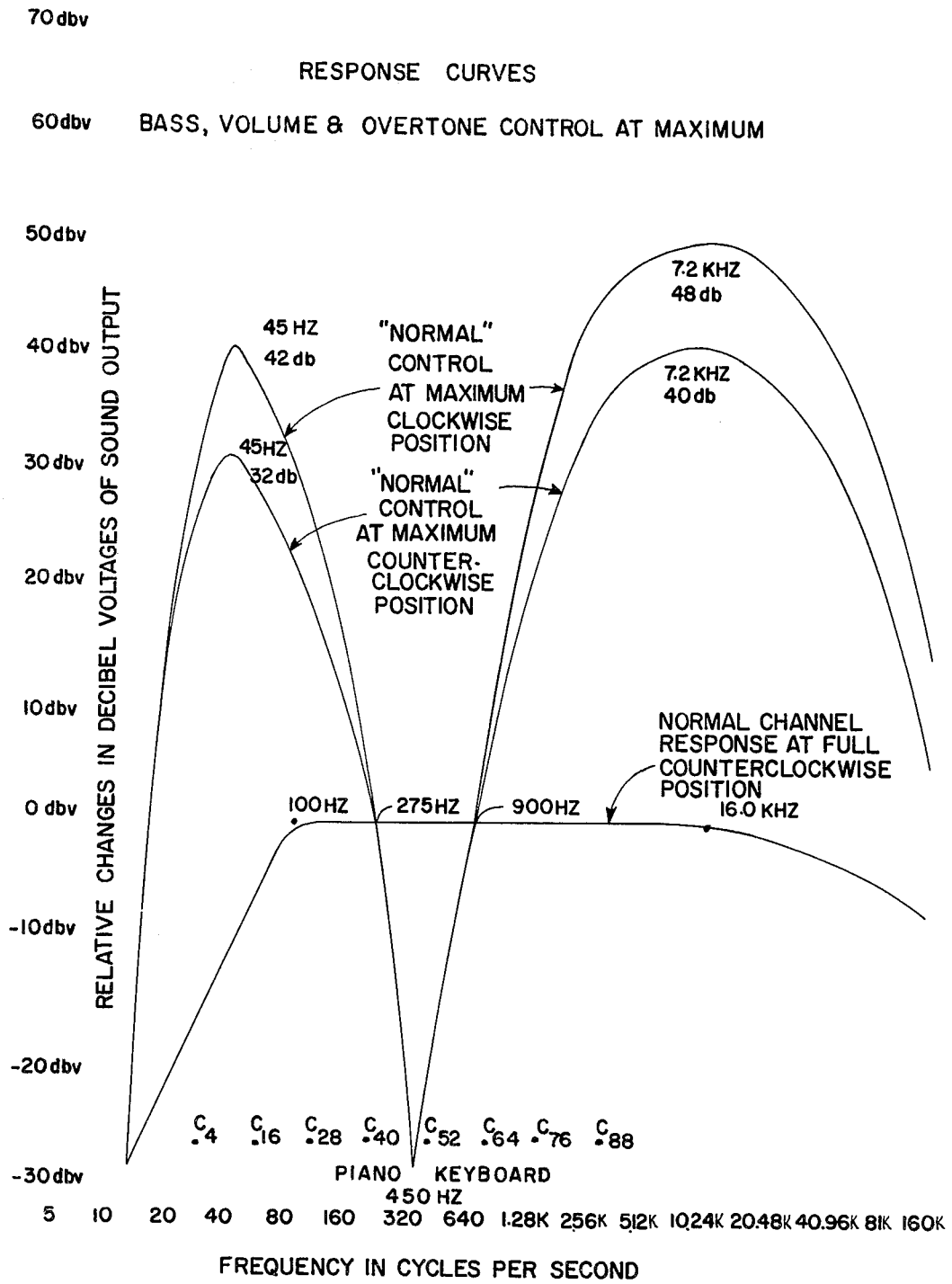
FIG. 3 is a response curve showing the relative changes in decibels of sound (ordinate) versus frequency (abcissa) upon which the frequency band of a conventional 88 key piano has been noted by octaves, there being twelve notes within each octave.

On FIG. 3 there is seen a series of curves showing the response obtained with my amplifier as compared with that of pianos not so equipped. Plotted vertically are the relative changes in decibel voltages of the sound output as measured by test. As plotted horizontally are the frequencies in cycles per second or Hertzes of the piano notes. Superimposed on this shown as $C_4$ to $C_8$ are the 88 keys representing the seven octaves indicated by C's of a keyboard. The values shown were obtained by actual tests when the bass, volume and overtone controls, namely, those controlled by potentiometers $R_{17}$, $R_{18}$ and $R_{14}$ of FIG. 2 were placed at their maximum setting and variation made only by the potentiometer $R_8$ or what I choose to call the "normal" control. The upper curve shows the variation in response with the normal control potentiometer at its maximum clockwise position, whereas the lower curve shows it at its maximum counterclockwise position representing minimum and maximum values of resistance in the circuit respectively. It will be seen that in the maximum clockwise position, the response curve in the lower frequencies or tones peaks at 42 decibels at 45 Hertzes for the maximum counterclockwise position of the potentiometer at 45 Hertzes at 32 decibels for the minimum position.

In the upper range of frequencies in which the overtones predominate and which are sometimes classified as treble frequencies, it is seen that the curve peaks at approximately 48 decibels and frequency of approximately 7.2K Hertzes with the potentiometer in the maximum clockwise position. The response peak in the higher resistance area is 40 decibel volts at 7.2K Hertzes.

This should be compared to the decibel output reference on the normal channel response curve. Response curves such as the former represent the unusually superior tone quality obtained by use of my amplifier.

Referring now to FIG. 4, there is seen a perspective of my device in position over the keyboard of the piano.

Superimposed over a conventional keyboard 41 there is a first support 42 which also houses the power supply and a second support 43. These straddle the length of the piano. Power is supplied from 110–120 volt standard AC supply brought through power transformer and rectifier 44 to power supply box 42. Power control switch 45 is wired to connect to the AC supply through the rectifier to the battery supply or to the off position as shown and shown further in the block diagram FIG. 5. A control panel 46 is positioned above keyboard 41 and supports the housing for my amplifier circuit described above at 47. The inlet from the piano harp is connected to plug 48 and connection to chargeable batteries as shown at 49. The output from the amplifier circuit 47 is shown at plug 50 which is adapted to receive a jack for connecting to a loudspeaker and its own separate volume amplifier. The potentiometer controls which comprise a pair of concentric knobs are mounted on panel 46. These are the volume potentiometer 51 which appears on the wiring diagram as $R_{14}$. Normal control potentiometer 52 which appears on the wiring diagram as $R_8$, overtone potentiometer 53 which appears on the diagram as $R_{18}$, and bass boost 54 which appears as $R_{17}$. At 55 is seen a light emitting diode which indicates a charging condition of the batteries connected to 49, which, as indicated above, are of the rechargeable type.

Figure 5:
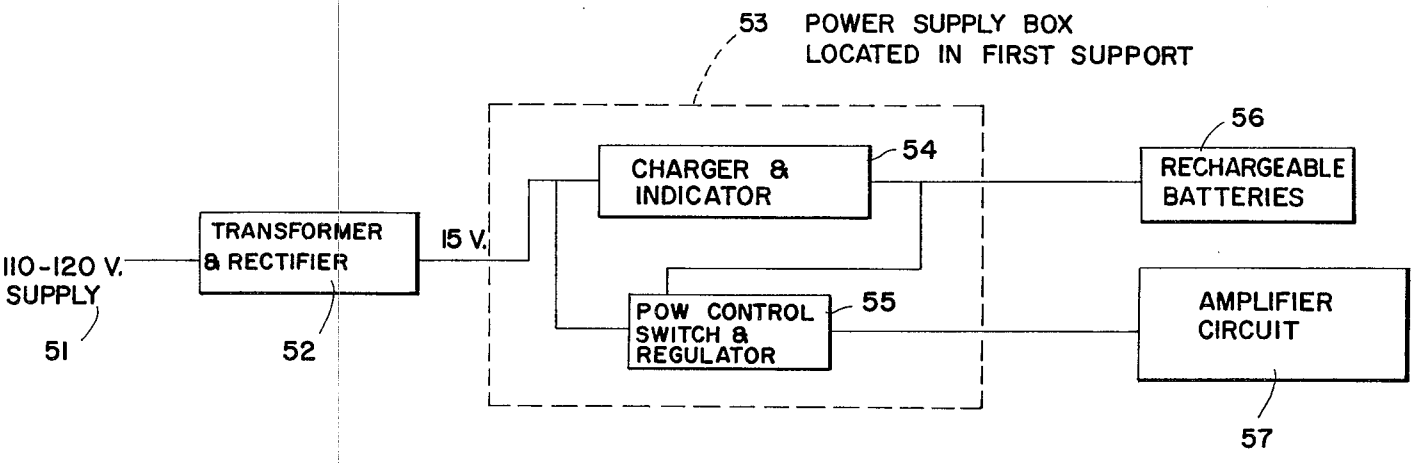
FIG. 5 is a block diagram of a power supply for the circuit described in FIGS. 1 and 2.

Referring now to FIG. 5 there is seen a block diagram of the power supply circuit positioned inside of box 42 of FIG. 4. A standard 110–120 volt supply 51 is connected to transformer rectifier 52 which supplies 15 volts to the inside of the power supply box 53. Inside this box is located a charger and indicator 54 and a power control switch and regulator 55. Rechargeable batteries are shown connected at 56 and the amplifier circuit at 57.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. In a device for controlling the tone quality put out by an electronic piano characterized by a harp for producing vibratory signals and by inductive transducers configured to detect said vibratory signals and convert them into electrical signals, an improved circuit interposed between said piano and subsequent amplifier and loudspeaker means, said circuit being characterized by a main signal path carrying fundamental tones of the piano and having a substantially flat frequency response throughout the audible spectrum above a predetermined low frequency, and by an overtone signal path having three separate bands, a bass boost band below a predetermined first frequency and a treble boost band above a predetermined second frequency higher than said predetermined first frequency with amplitude boosted tones therein, and a midrange null band between said bass boost band and said treble boost band with amplitude nulled tones therein, said circuit compising:

input means for connecting to said transducers and receiving said electrical signals;

first amplifier means connected to said input means, for amplifying said electrical signals and for providing one output to said main signal path, and another output to said overtone signal path;

second amplifier means connected to said first amplifier means in said main signal path for amplifying said tones passing through said main signal path and including amplitude control means for controlling the amplitude in said main signal path;

tone filter network means connected to said first amplifier means in said overtone signal path, for passing tones in said bass boost band and said treble boost band and for nulling tones in said midrange null band;

third amplifier means connected to said tone filter network means in said overtone path, for amplifying the tones in said bass boost band and said treble boost band by a controlled amount and having control means for controlling the amplification of tones in said bass boost band and in said treble boost band;

mixer means connected to said second amplifier means in said main signal path and to said third amplifier means in said overtone path for combining said tones from said paths in proper phase relationship into a single composite signal and for providing an output to said subsequent amplifier and loudspeaker means;

gate control means having an input connected to said output to said main channel of said first amplifier means and to said mixer means, for disabling said overtone path at the input to said mixer means whenever the signal level in said main signal path is below a predetermined threshold amplitude level.

2. The circuit set forth in claim 1 wherein said gate control means comprises an operational amplifier having an input connected to said main signal path output of said first amplifier means, a threshold determining transistor having an operative connection to the output of said operational amplifier and a threshold determining connection to a threshold setting control, and a high impedance switch operated by said transistor and connected to disable said overtone path whenever the signal level in said main signal path is below a predetermined threshold amplitude level.

3. In a device for controlling electronic piano tone output, an amplifier circuit having an input connected to the output of a harp of an electronic piano for improvement of the tone quality of said piano, comprising a plurality of interconnected electronic networks, said networks comprising:

a high impedance input variable gain network and controls;

said high impedance variable gain network and controls comprising, a first field effect transistor in series with the input to said circuit;

an ultrasonic roll-off capacitor connected from the drain to the source terminals of said transistor;

a capacitor and a potentiometer each in series with said roll-off capacitor;

a first resistor in parallel with said capacitor and a first terminal of said potentiometer and connected to the source terminal of said field effect transistor;

a second resistor connected between an adjustable terminal of said potentiometer and a second terminal of said potentiometer;

means for connecting said potentiometer to a second field effect transistor;

said second transistor forming a part of an output network;

a first tone filter network;

an amplifier network;

a second tone filter network having variable bass and variable overtone control;

said networks being connected in series with each other through field effect transistors forming a part of said networks;

a source of low voltage supply to each of said transistors;

means for connecting the output of said circuit through a variable volume control through an amplifier to a loudspeaker;

a common ground connection for all of said networks.

4. In a device for controlling electronic piano tone output, an amplifier circuit having an input connected to the output of an electronic piano for improvement of the tone quality of said piano comprising a plurality of interconnected networks, said networks comprising:

a high impedance variable gain network and controls;

a first tone filter network;

an amplifier network;

a second tone filter network having variable bass and variable overtone controls;

an output network and control;

said output network comprising, a first field effect transistor;

an ultrasonic roll-off capacitor connected from the drain to the terminal of source terminals of said first transistor;

a first set of degenerative feedback resistors and capacitors connected to said first transistor;

a second field effect transistor connecting with said variable gain network;

a second set of degenerative feedback resistors and capacitors connected to said second transistor;

a mixer resistor and a pair of output protection diodes forming a parallel circuit, said parallel circuit being connect in series with a volume control potentiometer, and a plug adaptor for connecting to a loudspeaker amplifier;

said networks being connected in series with each other through field effect transistors forming a part of said networks;

a source of low voltage supply to each of said transistors;

means for connecting the output of said circuit through a amplifier to a loudspeaker;

a common ground connection for all of said networks.

5. The device of claim 3 or claim 4 including harp resonant means comprising a resistor and a capacitor in parallel connection between said output of said harp and said input of said circuit.

6. The device of claim 3 or claim 4 in which said first ton filter network comprises a plurality of resistors and capacitors in connection with the input to said circuit.

7. The device of claim 3 or claim 4 in which said amplifier network comprises:

a first field effect transistor connected in series with said first filter tone network;

an ultrasonic roll-off capacitor connected from the drain to the source terminal of said transistor;

a resistor and a capacitor in parallel with the source terminal of said transistor comprising a subsonic roll-off.

8. The device of claim 3 or claim 4 in which said second tone filter network and variable controls comprise a plurality of resistors and capacitors connected with a first potentiometer disposed for bass control and a second potentiometer disposed for overtone control.

9. The device of claim 3 further comprising gate control means having an input connected to said first field effect transistor and having as an output electronic switch means for switching off said first and second tone filter networks whenever the audio tones put out by said first field effect transistor fall below a predetermined amplitude threshold level as determined by said gate control means.

* * * * *